US011802098B2

(12) United States Patent
Burn et al.

(10) Patent No.: US 11,802,098 B2
(45) **Date of Patent: *Oct. 31, 2023**

(54) PROCESS FOR MAKING AND FILLING A PBX COMPOSITION

(71) Applicant: BAE SYSTEMS plc, London (GB)

(72) Inventors: Andy Oden Burn, Monmouthshire (GB); Rebecca Elizabeth Stephens, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 1064 days.

This patent is subject to a terminal disclaimer.

(21) Appl. No.: 16/500,298

(22) PCT Filed: Mar. 28, 2018

(86) PCT No.: PCT/GB2018/050810

§ 371 (c)(1),
(2) Date: Oct. 2, 2019

(87) PCT Pub. No.: WO2018/185466

PCT Pub. Date: Oct. 11, 2018

(65) Prior Publication Data

US 2020/0062670 A1 Feb. 27, 2020

(30) Foreign Application Priority Data

Apr. 3, 2017 (EP) ..... 17275043
Apr. 3, 2017 (GB) ..... 1705320

(51) Int. Cl.
*C06B 21/00* (2006.01)

(52) U.S. Cl.
CPC ..... *C06B 21/0025* (2013.01); *C06B 21/0058* (2013.01)

(58) Field of Classification Search
None
See application file for complete search history.

(56) References Cited

U.S. PATENT DOCUMENTS 3,505,428 A 4/1970 Kidwell et al.
4,392,410 A 7/1983 Durrell
(Continued)

FOREIGN PATENT DOCUMENTS

DE 2327107 A1 2/1975
EP 2215033 A1 8/2010
(Continued)

OTHER PUBLICATIONS

International Preliminary Report on Patentablity for PCT Application No. PCT/GB2018/050810 dated Oct. 8, 2019, 7 pages.
(Continued)

*Primary Examiner* — Aileen B Felton
(74) *Attorney, Agent, or Firm* — Finch & Maloney PLLC

(57) ABSTRACT

The invention relates to a cast explosive composition.

Figure 1:
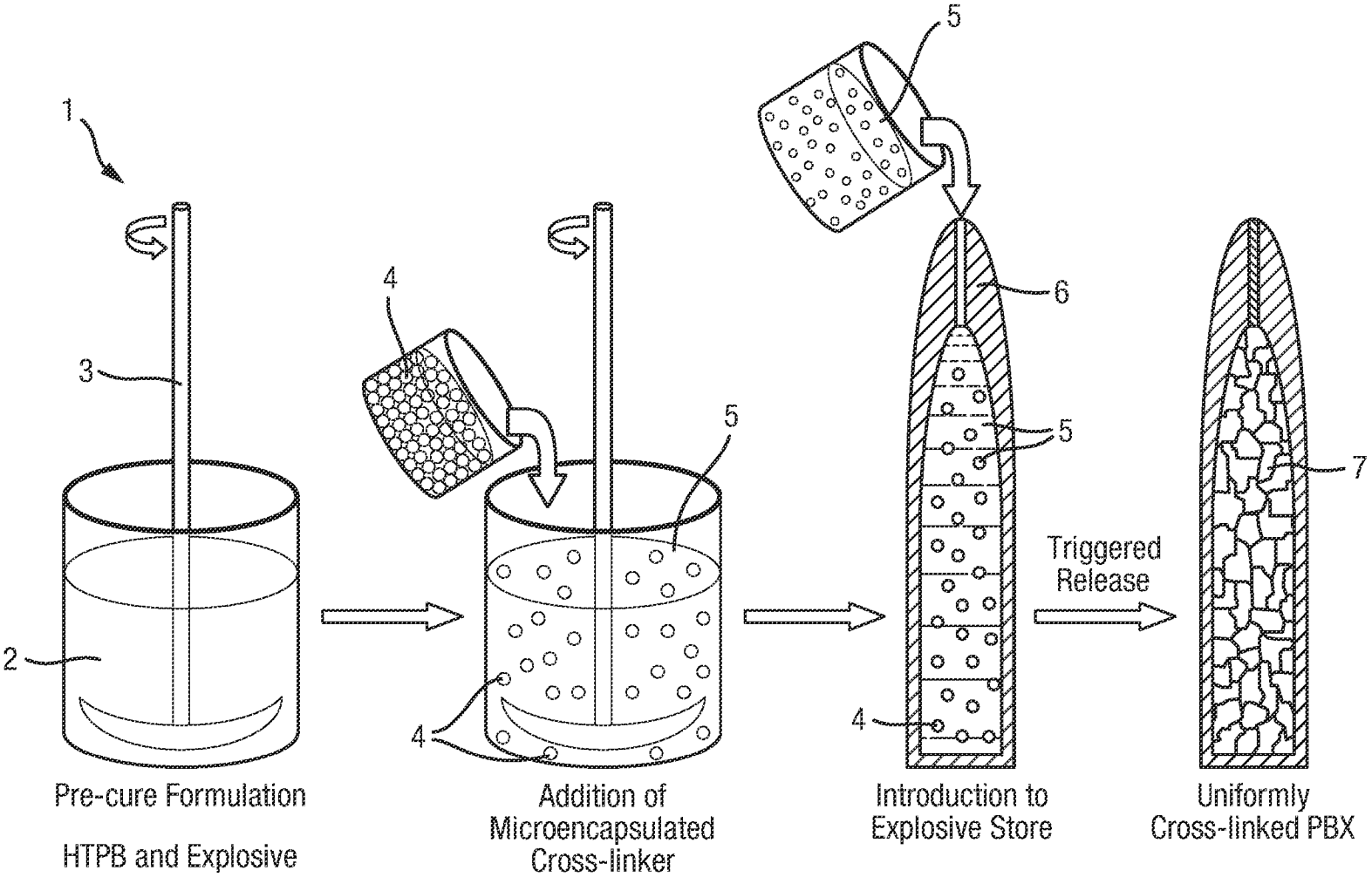

A process for formulating a homogenous crosslinked polymer bonded explosive composition comprising the steps of:

i) forming an admixture of precure castable explosive composition, comprising an explosive material, a polymerisable binder, and a cross linking reagent which comprises at least two reactive groups each of which is protected by a labile blocking group, wherein the labile blocking groups, comprise at least one resonant acoustic mixing stimulus labile linkage, ii) applying resonant acoustic mixing stimulus to the admixture, causing the at least one resonant acoustic mixing stimulus labile linkage to be removed and release said cross linking reagent, to cause the cure process to start.

(Continued)

20 Claims, 3 Drawing Sheets

(56) References Cited

U.S. PATENT DOCUMENTS

| | | | |
|---|---|---|---|
| 7,188,993 | B1 | 3/2007 | Howe et al. |
| 2010/0294113 | A1 | 11/2010 | McPherson |

FOREIGN PATENT DOCUMENTS

| | | | | |
|---|---|---|---|---|
| GB | WO2017006110 | | * | 1/2017 |
| GB | WO 2017064102 | | * | 4/2017 |
| GB | 2540158 | A | | 11/2017 |
| GB | 2555764 | A | | 5/2018 |
| WO | 2009091430 | A1 | | 7/2009 |
| WO | WO 2009091430 | | * | 7/2009 |
| WO | 2017006109 | A1 | | 1/2017 |
| WO | 2017006110 | A1 | | 12/2017 |
| WO | 2018185465 | A1 | | 10/2018 |
| WO | 2018185466 | A1 | | 10/2018 |

OTHER PUBLICATIONS

International Search Report and Written Opinion received for PCT Application No. PCT/GB2018/050809. dated Jun. 6, 2018. 14 pages.

GB Search Report under Section 17(5) received for GB Application No. 1705320.8 dated Oct. 3, 2017. 4 pages.

GB Search Report under Section 17(6) (as it relates to claims 13-15) received for GB Application No. 1705320.8 dated Feb. 13, 2018. 2 pages.

Extended European Search Report received for EP Application No. 17275043.2, dated Oct. 20, 2017. 8 pages.

GB Combined Search and Examination Report under Sections 17 and 18(3) received for GB Application No. 1804965.0 dated Nov. 30, 2018. 5 pages.

International Search Report and Written Opinion received for PCT Application No. PCT/GB2018/050810. dated Sep. 20, 2018. 12 pages.

* cited by examiner

PROCESS FOR MAKING AND FILLING A PBX COMPOSITION

This invention relates to polymer bonded explosive compositions, their preparation and use. In particular, the invention relates to the use of resonant acoustic mixing stimulus to formulate polymer-bonded explosive compositions for munitions.

Explosive compositions are generally shaped, the shape required depending upon the purpose intended. Shaping can be by casting, pressing, extruding or moulding; casting and pressing being the most common shaping techniques. However, it is generally desirable to cast explosives compositions as casting offers greater design flexibility than pressing.

Polymer-bonded explosives (also known as plastic-bonded explosives and PBX) are typically explosive powders bound into a polymer matrix. The presence of the matrix modifies the physical and chemical properties of the explosive and often facilitates the casting and curing of high melting point explosives. Such explosives could otherwise only be cast using melt-casting techniques. Melt casting techniques can require high processing temperatures as they generally include a meltable binder. The higher the melting point of this binder, the greater the potential hazard. In addition, the matrix can be used to prepare polymer-bonded explosives which are less sensitive to friction, impact and heat; for instance, an elastomeric matrix could provide these properties.

The matrix also facilitates the fabrication of explosive charges which are less vulnerable in terms of their response to impact, shock, thermal and other hazardous stimuli. Alternatively, a rigid polymer matrix could allow the resulting polymer-bonded explosive to be shaped by machining, for instance using a lathe, allowing the production of explosive materials with complex configurations where necessary.

Conventional casting techniques require the polymerisation step to have commenced during the fill stage which often results in a solidified composition which retains air bubbles introduced during mixing of the material, non-homogenous crosslinking, and in certain cases solidification of the "pot" of explosive before all munitions or moulds have been filled. The non-homogenous cross linking can reduce the performance of the composition as less explosive is present per unit volume. In addition, these defects may affect the shock sensitivity of the composition, making the composition less stable to impact or initiation from a shock wave.

The invention seeks to provide a cast explosive composition in which the stability of the composition is improved. Such a composition would not only offer improved stability, but also a reduced sensitivity to factors such as friction, impact and heat. Thus, the risk of inadvertent initiation of the explosive is diminished.

According to a first aspect of the invention there is provided a process for formulating a homogenous cross-linked polymer bonded explosive composition comprising the steps of:

i) forming an admixture of precure castable explosive composition, comprising an explosive material, a polymerisable binder, and a cross linking reagent which comprises at least two reactive groups, each of which is protected by a labile blocking group, wherein the labile blocking groups, comprises at least one resonant acoustic mixing stimulus labile linkage, ii) applying resonant acoustic mixing stimulus to the admixture, causing the at least one resonant acoustic mixing stimulus labile linkage to be removed and release said cross linking reagent, to cause the cure process to start; optionally comprising the further step of iii) filling a munition with the admixture from step ii).

Current processes used in the production of composite rubber materials involve mixing a hydroxy-terminated aliphatic polymer with a cross linking reagent. Upon addition, an immediate polymerisation reaction occurs, leading to the formation of a non-homogeneous cross linked rubber matrix. Formation of a non-homogenous matrix leads to material being rejected or the mixture fully polymerising before all munitions or moulds have been filled. This leads to the rejected material requiring disposal, a process that has both cost and hazard associated.

The resonant acoustic mixing labile linkage, is part of a labile blocking group. The labile part of the linkage may be the direct chemical bond with the reactive group. The use of a labile blocking group is to protect the reactive groups of the cross linking reagent, which then allows uniform distribution of the (blocked) cross linking reagent within the precure composition, thereby allowing control of when the curing reaction may be initiated. Upon application of a resonant acoustic mixing stimulus, the blocking group may be removed such that the reactive groups may be free, so as to allow the cross linking reaction to commence with the polymerisable binder, and permit the formation of a uniform PBX polymeric matrix, when desired. The removal of the blocking group, may be breaking of one or more chemical bonds, in such a fashion that the blocking group is cleaved, and separated from the reactive group, so as to furnish the reactive group, ready for subsequent reaction.

The labile blocking group may on each of the at least two reactive groups on the cross linking reagent, be the same group, or independently selected. The labile blocking groups may be independently selected so as to be removed at different resonant acoustic mixing stimulus durations or frequencies or power.

The enhanced control of the start of the cross linking reactions allows the recovery of the precure composition in the event of process equipment failure. In a conventional cure process many tonnes of material would end up solidifying/curing in the reaction vessel, as once the reaction has started it cannot be readily stopped. Further, the delay of the cure reaction allows product quality to be confirmed, before the reaction is allowed to commence, thereby a poor quality composition, may be prevented from being filled into moulds or munitions. The use of labile blocking groups on the reactive groups of the cross linking reagent may reduce the exposure to operators of hazardous cross linking reagents.

In a further arrangement the polymerisable binder may be partially polymerised with the cross linking reagent, such that at least one of the at least two reactive groups on the cross linking reagent has formed a bond with the polymerisable binder, and at least one of the at least two reactive groups may protected by a labile blocking group, such that on removal of the remaining labile blocking group(s) substantially complete polymerisation with the polymerisable binder may occur.

In a preferred arrangement the polymerisable binder and cross linking reagent are partially reacted together to provide a partially polymerised binder-cross linking reagent, before it is filled into the munition or subjected to resonant acoustic mixing, wherein at least one of the at least two reactive groups of the cross linking reagent is protected by a labile blocking group.

Where the cross linking reagent has low or poor solubility in the polymerisable binder or explosive material, the formation of a partially polymerised polymerisable binder/cross linking reagent may provide a means of increasing homogeneity of the binder in the explosive composition.

The partially polymerised polymerisable binder/cross linking reagent may be extracted and purified, to provide a reduced mass of removed labile protecting group in the final cured PBX.

WO2017/006109 describes the use of thermally labile blocking groups on cross linking reagents, such that the mixture when heated may cause removal of blocking groups and concomitant release of the cross linking reagent.

The use of resonant acoustic mixing technique allows the precure composition to be mixed to form a homogenous mixture. The action of the resonant acoustic mixing stimulus causes the removal of the blocking group to allow the release of the protected cross linking reagent. The continued application of resonant acoustic mixing stimulus to the precure composition with released cross linking reagent, allows for facile continued mixing of the composition to ensure a homogeneous mixture and a homogenous cured mixture.

The precure composition may be mixed in a large batch process of >100 Kg to provide a homogenous mixture and the resonant acoustic mixing stimulus applied directly to the mixing container. The resonant acoustic mixing stimulus will cause the blocking groups to be removed allowing the crosslinking reagent to come into contact with the polymerisable binder, such that cure process starts within the large batch mixer. The curing composition may then be transferred to the munitions or pots for filling and to fully cure.

According to a further aspect of the invention there is provided a process for filling a munition with a homogenous crosslinked polymer bonded explosive composition comprising the steps of:

i) forming an admixture of precure castable explosive composition, comprising an explosive material, a polymerisable binder, and a cross linking reagent which comprises at least two reactive groups each of which is protected by a labile blocking group, wherein the labile blocking group comprises at least one resonant acoustic mixing stimulus labile linkage;

ii) filling the munition, iii) applying resonant acoustic mixing stimulus to the munition, causing the at least one resonant acoustic mixing stimulus labile linkage to be removed and to release said cross linking reagent, to cause the cure process to start in the munition; and thereby fully cure in the munition.

The precure composition may be first formed to an admixture using conventional mixing techniques in a large batch mixer, and transferred to a munition or pot for incorporation into a muniton. Using conventional mixing techniques, it may be extremely difficult to provide continuous mixing to the precure composition once it is inside a munition or pot. This would require a plurality of mixing blades to stir the precure composition, in the muntion or pot. The fill level on munitions may be tightly controlled, so the use of mixing blades or probes that are inserted into the precure composition in a munition may cause removal of material, spillages or even accidental insertion of foreign objects, debris. The use of resonant acoustic stimulus allows for concomitant mixing and removal of the labile blocking groups to occur whilst the pre cure composition is in the munition or pot. The munitions or pots may be individually brought into contact with a resonant acoustic stimulus, or more preferably a plurality of munitions or pots may be arranged in a rack and the rack subjected to the resonant acoustic mixing stimulus.

The resonant acoustic mixing stimulus cure process may be carried out under vacuum, so as to remove volatiles and degas ie remove air, to prevent the formation of voids in the final cured formulation.

The resonant acoustic mixing stimulus process may be affected at different frequencies, at a first frequency/power the resonant acoustic mixing stimulus may provide only homogeneous mixing of the formulation, but is insufficient to cause removal of the labile blocking groups. At an second frequency/power the resonant acoustic mixing stimulus process provides both homogenous mixing of the precure composition and concomitant removal of the resonant acoustic mixing stimulus labile blocking groups.

Resonant acoustic mixing is far removed from sonification (or ultrasound) techniques. Ultrasound employs very high frequencies, typically greater than 20 KHz.

In a highly preferred arrangement the resonant acoustic mixing labile blocking groups may be caused to at a frequency in the range of less than 200 Hz, preferably less than 100 Hz, preferably from 20 Hz to 100 Hz, more preferably in the range of from 50 Hz to 70 Hz, yet more preferably 58 Hz to 60 hz. The resonant acoustic mixing occurs at very low frequencies, in the order of tens of hertz, compared to those used in sonification (ultrasound), which is tens of thousands of hertz.

Typically the resonant acoustic mixing stimulus may apply an acceleration force of up to 100 g.

Resonant acoustic mixing induces microscale turbulence by propagating acoustic waves of a low frequency throughout a mixture. The resonant acoustic mixing system has a lower frequency of acoustic energy and can be more readily applied to larger scale of mixing than ultrasonic agitation. The mixing time for typical shear force mixers may be in the order of several hours to ensure homogenous mixing, in resonant acoustic mixing the stimulus may cause the time to be reduced to less than hour, more preferably less than 20 mins or even less than 5 minutes. The period of time may depend on the size of the munition or pot that needs to be subjected to the resonant acoustic mixing stimulus. The resonant acoustic mixing stimulus will be applied until the removal of the blocking groups has occurred.

The process of using a resonant acoustic mixing stimulus will generate some heat within the precure composition that comprising the labile blocking groups, however the temperature will be significantly lower than the temperature required to thermally remove the labile blocking groups. The removal of the resonant acoustic mixing stimulus labile blocking groups is due to primarily the vibrational i.e. mechanical forces, rather than a pure thermal stimulus. This allows for the precure composition to be processed at temperatures below that in WO2017/006109.

The curing step, after the release cross linking reagent, is exothermic and will generate further heat. It may be desirable to provide cooling jackets to a batch mixer or munitions or pots, to ensure the temperature does not increase towards the ignition temperature of the energetic material.

The explosive component of the polymer-bonded explosive may, in certain embodiments, comprise one or more heteroalicyclic nitramine compounds. Nitramine compounds are those containing at least one N—$NO_2$ group. Heteroalicyclic nitramines bear a ring containing N—$NO_2$ groups. Such ring or rings may contain for example from two to ten carbon atoms and from two to ten ring nitrogen atoms. Examples of preferred heteroalicyclic nitramines are RDX (cyclo-1,2,3-trimethylene-2,4,6-trinitramine, Hexogen), HMX (cyclo-1,3,5,7-tetramethylene-2,4,6,8-tetranitramine, Octogen), and mixtures thereof. The explosive component may additionally or alternatively be selected from TATND (tetranitro-tetraminodecalin), HNS (hexanitrostilbene), TATB (triaminotrinitrobenzene), NTO (3-nitro-1,2,4-triazol-5-one), HNIW (2,4,6,8,10,12-hexanitrohexaazaisowurtzitane), GUDN (guanyldylurea dinitride), FOX-7 (1,1-diamino-2, 2-dinitroethene), and combinations thereof.

Other highly energetic materials may be used in place of or in addition to the compounds specified above. Examples of other suitable known highly energetic materials include picrite (nitroguanidine), aromatic nitramines such as tetryl, ethylene dinitramine, and nitrate esters such as nitroglycerine (glycerol trinitrate), butane triol trinitrate or pentaerythritol tetranitrate, DNAN (dinitroanisole), trinitrotoluene (TNT), inorganic oxidisers such as ammonium salts, for instance, ammonium nitrate, ammonium dinitramide (ADN) or ammonium perchlorate, and energetic alkali metal and alkaline earth metal salts.

Polymer-bonded explosives include a polymeric binder which forms a matrix bonding explosive particles within. The polymerisable binder thus may be selected from a wide range of polymers, depending upon the application in which the explosive will be used. However, in general at least a portion of the polymerisable binder will be selected, when cross linked to form polyurethanes, cellulosic materials such as cellulose acetate, polyesters, polybutadienes, polyethylenes, polyisobutylenes, PVA, chlorinated rubber, epoxy resins, two-pack polyurethane systems, alkyd/melanine, vinyl resins, alkyds, thermoplastic elastomers such as butadiene-styrene block copolymers, and blends, copolymers and/or combinations thereof.

Energetic polymers may also be used either alone or in combination, these include polyNIMMO (poly(3-nitratomethyl-3-methyloxetane), polyGLYN (poly glycidyl nitrate) and GAP (glycidyl azide polymer). It is preferred that the polymerisable binder component be entirely selected from the list of polymerisable binders and/or energetic binders above either alone or in combination.

Polyurethanes are highly preferred polymerisable binders for PBX formation. In some embodiments the polymerisable binder will comprise at least partly polyurethane, often the binder will comprise 50-100 wt % polyurethane, in some instances, 80-100 wt %.

The cross linking reagents may be selected from a variety of commonly known, cross linking reagents, the selection of which depends on the functionality of the polymerisable binders.

The highly preferred polyurethanes may typically be prepared by reacting polyol-terminated monomers or polymers with polyisocyanates. In a preferred arrangement a monomer or polymer diol may be cross linked with a cross linking reagent such as a diisocyanate.

The diisocyanate may be such as, for example, MDI (methylene diphenyl diisocyanate) and TDI (toluene diisocyanate) and IPDI (isophorone diisocyanate). IPDI is generally preferred as it is a liquid and hence easy to dispense; it is relatively slow to react, providing a long pot-life and slower temperature changes during reaction; and it has a relatively low toxicity compared to most other isocyanates. It is also preferred that, where the polymerisable binder comprises polyurethane, the polyurethane polymerisable binder includes a hydroxyterminated polybutadiene.

The labile blocking group is any reversible blocking group that may be furnished on the at least two reactive groups on the cross linking reagent, but which can be removed at a selected time by the resonant acoustic mixing stimulus.

The labile blocking group may be removed by a further stimulus, such as, for example one or more of, heat, pressure, EM radiation, catalyst, or a shear force.

In a preferred arrangement the labile blocking group is a resonant acoustic mixing labile blocking group, one that is removable when subjected to resonant acoustic mixing.

The blocking group may comprise at least one nitro group, preferably at least two nitro groups or at least one sterically hindered branched chain hydrocarbyl group.

The use of nitro, dinitro or trinitro groups on the aryl rings provides increased exothermic energy of the blocking group, and hence increased energy to the explosive composition.

In a highly preferred arrangement the cross linking reagent is a diisocyanate group, with two blocking groups B, one on each isocyanate reactive group.

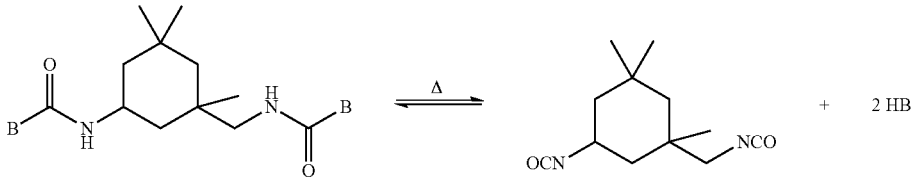

The labile blocking group B may comprise at least one nitro group, preferably at least two nitro groups or at least one sterically hindered branched chain hydrocarbyl group.

The use of nitro, dinitro or trinitro groups, such as for example on an aromatic ring, such as for example an aryl, phenyl or phenolic rings provides increased exothermic energy of the blocking group B, and hence increased energy to the explosive composition.

In a highly preferred arrangement the diisocyanate blocking group B is selected from B is I. $NHR^2R^3$, wherein $R^2$ and $R^3$ are alkyl, alkenyl, branched-chain alkyl, $C(O)R^{12}$, aryl, phenyl, or together form a heterocycle.

$R^{12}$ is alkyl, alkenyl, branched chain alkyl aryl, phenyl, or $R^2$ and $R^3$ together form a lactam.

II. $OR^{15}$, $O—N=CR^9R^{10}$ wherein $R^{15}$ is aryl, phenyl, benzyl, provided that there are at least two nitro group on the ring;

wherein $R^9$ and $R^{10}$ are independently selected from alkyl, alkenyl, branched chain alkyl, aryl, phenyl, provided that at least one of $R^9$ or $R^{10}$ is a branched chain alkyl or aryl, or phenyl.

| Blocking Group | Deblocking Temperature Range (° C.) |
|---|---|
| 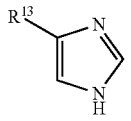 Aromatic heterocycles | 110-160 |
| 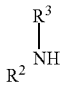 Amines | 40-130 |
| 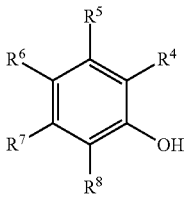 Phenols | 75-180 |
| 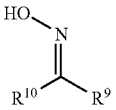 Oximes | 100-140 |
| 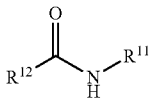 Amides | 100-157 |

In a preferred arrangement $R^4$-$R^8$ may be selected from halo, nitro, lower chain $C_{1-6}$ alkyl, In a preferred arrangement the substituted phenol comprises at least two nitro groups.

$R^2$, $R^3$, $R^9$, and $R^{10}$ may be selected from, nitro, aryl, phenyl, lower chain $C_{1-6}$ alkyl, branched chain $C_{1-8}$ alkyl, preferably isopropyl or tert-butyl.

It has been found that for blocking groups B an increase in steric hindrance of, $R^2$, $R^3$, $R^9$, and $R^{10}$ reduces the deblocking temperature, i.e. the reverse reaction to the free isocyanate.

Further reagents or further stimuli may be added to the composition to cause the curing reaction to commence, after the cross linking reagent has been de-blocked. In a highly preferred arrangement, the curing reaction will commence directly as a result of causing the removal of the blocking group to furnish said reactive group on the cross linking reagent.

The explosive component of the polymer-bonded explosive may be in admixture with a metal powder which may function as a fuel or which may be included to achieve a specific terminal effect. The metal powder may be selected from a wide range of metals including aluminium, magnesium, tungsten, alloys of these metals and combinations thereof. Often the fuel will be aluminium or an alloy thereof; often the fuel will be aluminium powder.

In some embodiments, the polymer-bonded explosive comprises RDX. The polymer-bonded explosive may comprise RDX as the only explosive component, or in combination with a secondary explosive component, such as HMX. Preferably, RDX comprises 50-100 wt % of the explosive component.

In many cases the polymerisable binder will be present in the range about 5-20 wt % of the polymer-bonded explosive, often about 5-15 wt %, or about 8-12 wt %. The polymer-bonded explosive may comprise about 88 wt % RDX and about 12 wt % polyurethane binder. However, the relative levels of RDX to polyurethane binder may be in the range about 75-95 wt % RDX and 5-25 wt % polyurethane binder. Polymer-bonded explosives of this composition are commercially available, for example, Rowanex 1100™.

Many defoaming agents are known and in general any defoaming agent or combination thereof which does not chemically react with the explosive may be used. However, often the defoaming agent will be a polysiloxane. In many embodiments, the polysiloxane is selected from polyalkyl siloxanes, polyalkylaryl siloxanes, polyether siloxane copolymers, and combinations thereof. It is often preferred that the polysiloxane be a polyalkylsiloxane; polydimethylsiloxane may typically be used. Alternatively, the defoaming agent may be a combination of silicone-free surface active polymers, or a combination of these with a polysiloxane. Such silicone-free polymers include alkoxylated alcohols, triisobutyl phosphate, and fumed silica. Commercially available products which may be used include, BYK 088, BYK A500, BYK 066N and BYK A535 each available from BYK Additives and Instruments, a subdivision of Altana; TEGO MR2132 available from Evonik; and BASF SD23 and SD40, both available from BASF. Of these, BYK A535 and TEGO MR2132 are often used as they are solventless products with good void reduction properties.

Often the defoaming agent is present in the range about 0.01-2 wt %, in some instances about 0.03-1.5 wt %, often about 0.05-1 wt %, in many cases about 0.25 or 0.5-1 wt %. At levels below this (i.e. below 0.01 wt %) there is often insufficient defoaming agent in the composition to significantly alter the properties of the polymer-bonded explosive, whereas above this level (i.e. above 2 wt %) the viscosity of the cast solution may be so low that the composition becomes non-homogenous as a result of sedimentation and segregation processes occurring within the mixture.

The explosive composition may include a solvent, any solvent in which at least one of the components is soluble and which does not adversely affect the safety of the final product may be used, as would be understood by the person skilled in the art. However, it is preferred, for the reasons described above, that in some embodiments that solvent be absent.

Where present, the solvent may be added as a carrier for the components of the composition. The solvent will typically be removed from the explosive composition during the casting process, however some solvent residue may remain due to imperfections in the processing techniques or where it becomes uneconomical to remove the remaining solvent from the composition. Often the solvent will be selected from diisobutylketone, polypropylene glycol, isoparaffins, propylene glycol, cyclohexanone, butyl glycol, ethylhexanol, white spirit, isoparaffins, xylene, methoxypropylacetate, butylacetate, naphthenes, glycolic acid butyl ester, alkyl benzenes and combinations thereof. In some instances, the solvent is selected from diisobutylketone, polypropylene glycol, isoparaffins, propylene glycol, isoparaffins, and combinations thereof.

The composition may also contain minor amounts of other additives commonly used in explosives compositions. Examples of these include microcrystalline wax, energetic plasticisers, non-energetic plasticisers, anti-oxidants, catalysts, curing agents, metallic fuels, coupling agents, surfactants, dyes and combinations thereof. Energetic plasticisers may be selected from eutectic mixtures of alkylnitrobenzenes (such as dinitro- and trinitro-ethyl benzene), alkyl derivatives of linear nitramines (such as an N-alkyl nitrato-ethyl-nitramine, for instance butyl-NENA), and glycidyl azide polymers.

Casting the explosive composition offers a greater flexibility of process design than can be obtained with pressing techniques. This is because the casting of different shapes can be facilitated through the simple substitution of one casting mould for another. In other words, the casting process is backwards-compatible with earlier processing apparatus. Conversely, where a change of product shape is required using pressing techniques, it is typically necessary to redesign a substantial portion of the production apparatus for compatibility with the mould, or the munition to be filled, leading to time and costs penalties. Further, casting techniques are less limited by size than pressing techniques which depend upon the transmission of pressure through the moulding powder to cause compaction. This pressure falls off rapidly with distance, making homogeneous charges with large length to diameter ratios (such as many shell fillings) more difficult to manufacture.

In addition, the casting process of the invention offers a moulded product (the cast explosive compositions described) with a reliably uniform fill regardless of the shape required by the casting. This may be partly attributed to the use of a delayed curing technique, Casting can occur in situ with the housing (such as a munition) to be filled acting as the mould; or the composition can be moulded and transferred into a housing in the munition in a separate step. Often casting will occur in situ.

Further, compositions including polymer-bonded explosives and hydroxyterminated polybutadiene binders in particular, are more elastomeric when cast than when pressed. This makes them less prone to undergoing a deflagration-to-detonation transition when exposed to accidental stimuli. Instead, such systems burn without detonating, making them safer to use than pressed systems.

Additionally, the shapes that pressing processes can be reliably applied to are more limited. For instance, it is often a problem achieving a complete fill of a conical shape using pressing techniques as air is often trapped at or towards the tip of the cone. Casting processes, being intrinsically "fluid" processes, are not limited in this way.

In some instances the explosive component is desensitized with water prior to formation of the premix, a process known as wetting or phlegmatization. However, as retention of water within the precure is generally undesirable it will typically be removed from the premix prior to further processing, for instance by heating during the mixing of the explosive component and the plasticiser.

In some cases the plasticiser will be absent; however the plasticiser will typically be present in the range 0-10 wt % of the plasticiser and explosive premix, often in the range 0.01-8 wt %, on occasion 0.5-7 wt % or 4-6 wt %. The plasticiser will often be a non-energetic plasticiser, many are known in the art; however energetic plasticisers may also be used in some instances. The cast explosive composition of the invention has utility both as a main charge or a booster charge in an explosive product. Often the composition will be the main charge. The composition of the invention may be used in any "energetic" application such as, for example, uses include mortar bombs and artillery shells as discussed above. Additionally, the inventive composition may be used to prepare explosives for gun-launch applications, explosive filings for bombs and warheads, propellants, including composite propellants, base bleed compositions, gun propellants and gas generators.

Except in the examples, or where otherwise explicitly indicated, all numbers in this description indicating amounts of material or conditions of reaction, physical properties of materials and/or use are to be understood as modified by the word "about." All amounts are by weight of the final composition, unless otherwise specified. Further, the cast explosive composition may comprise, consist essentially of, or consist of any of the possible combinations of components described above and in the claims except for where otherwise specifically indicated.

An embodiment of the invention will now be described by way of example only and with reference to the accompanying drawings of which:—

FIG. 1 shows a prior art schematic of the fill of an HE ammunition process

Figure 2A:
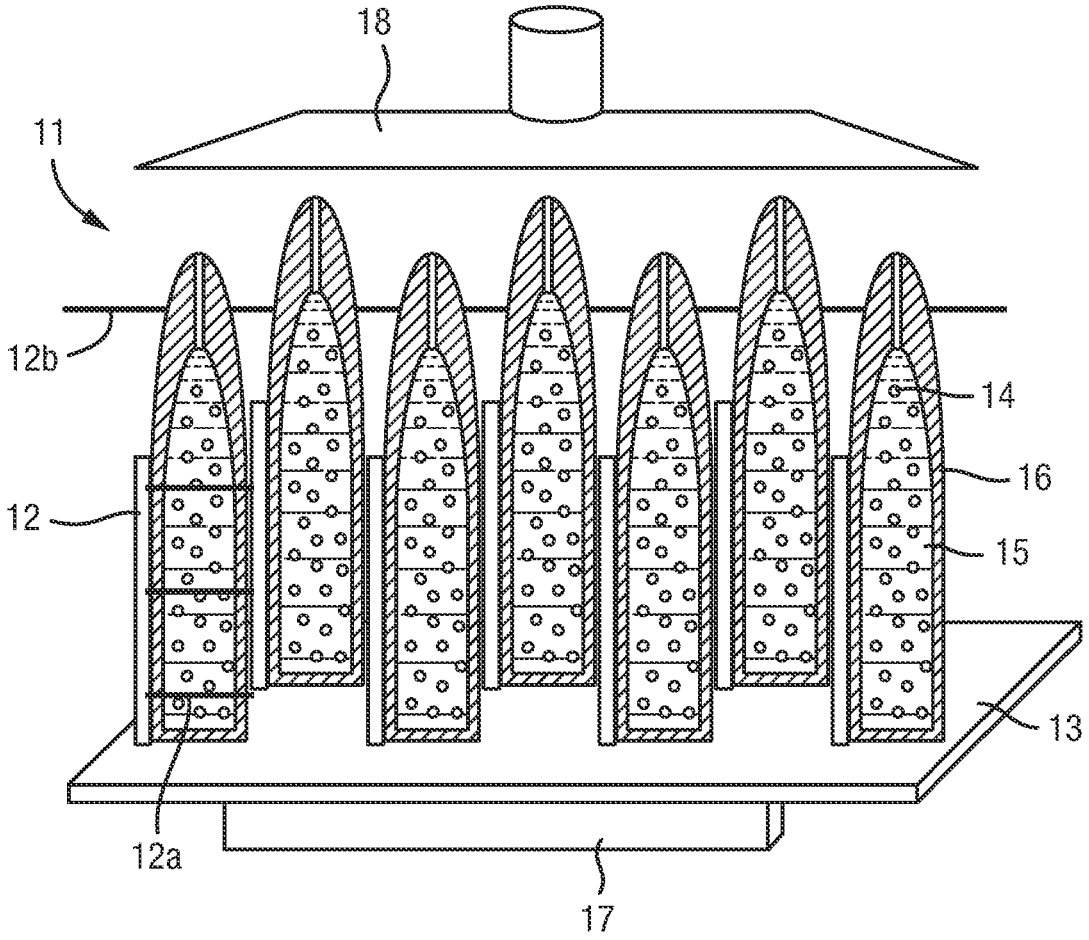
Figure 2B:
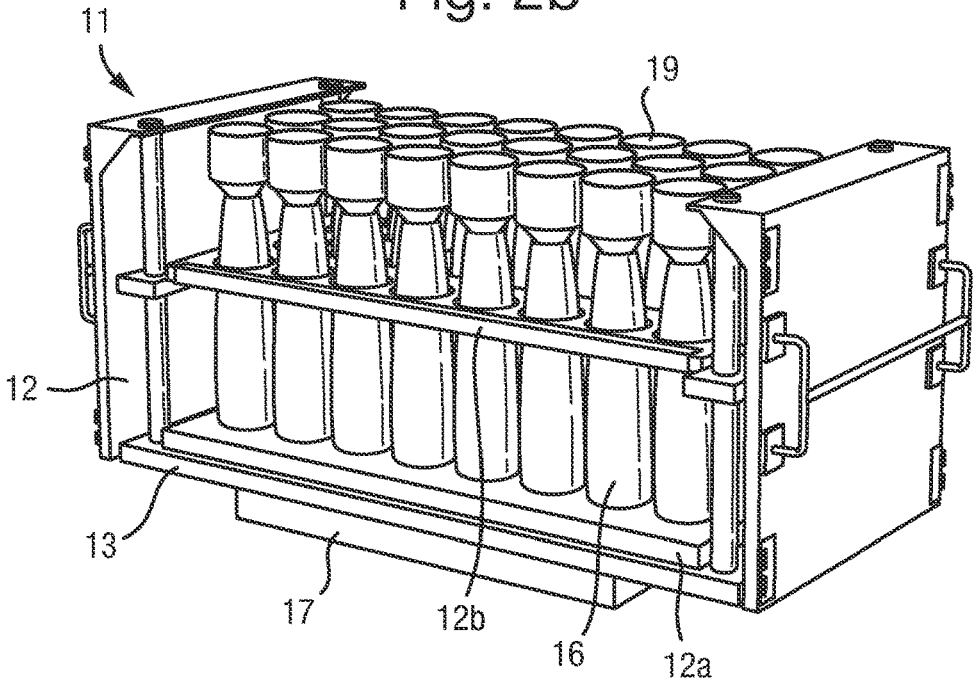
Figure 3:
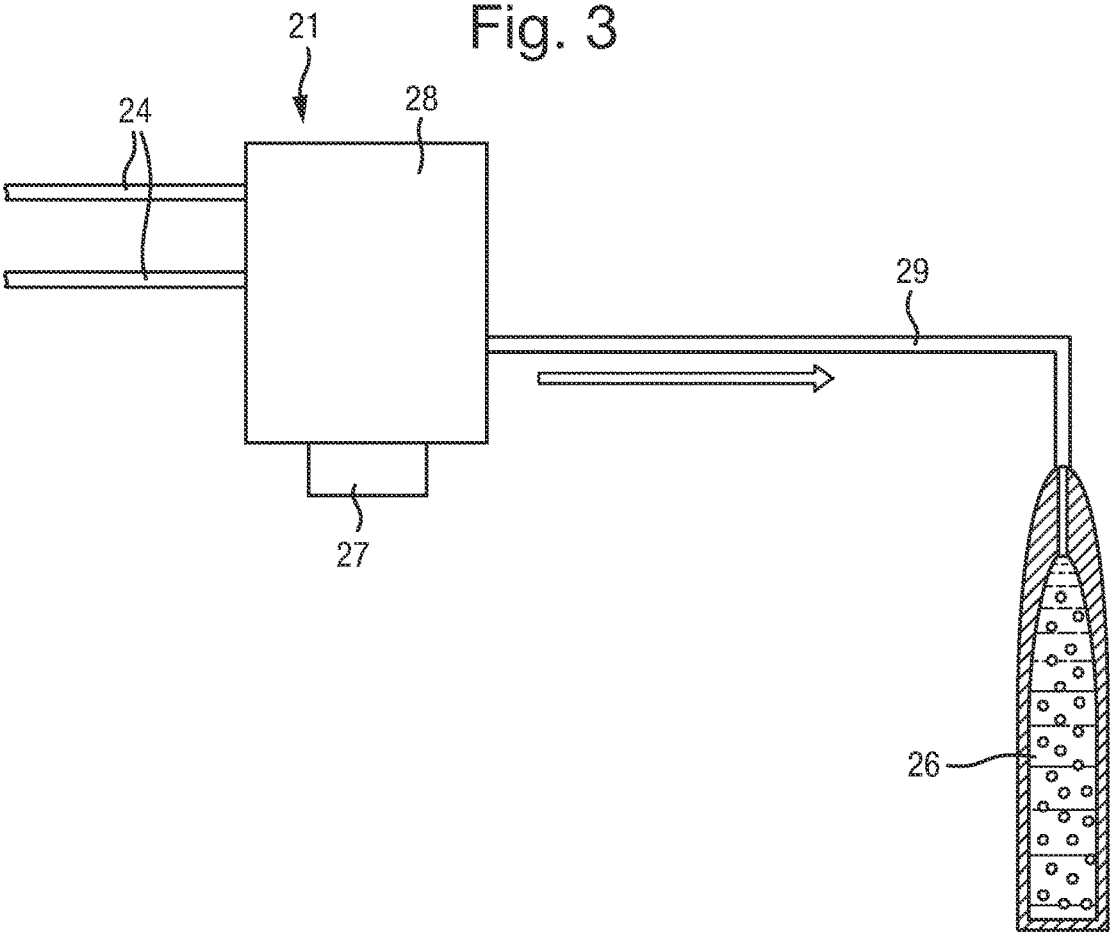

FIGS. 2*a* and 2*b* shows a schematic of the fill of an HE ammunition using a resonant acoustic mixing stimulus process FIG. 3 shows a continuous filling process arrangement.

Turning to FIG. 1 there is a general prior art scheme 1, for filling a munition 6. The premix formulation 2, is a mixture of the explosive, HTBP polymerisable binder and other processing aids, and optionally a catalyst. The premix formulation 2 is agitated such as by a stirrer 3. A blocked cross linking reagent 4, (either as a solid or dissolved in a minimal aliquot of solvent), is added to the premix to form the precure formulation 5. The blocked cross linking reagent 4 may be a diisocyanate such as IPDI. The resultant precure admixture 5 is thoroughly mixed and is transferred to a munition 6 or mould (not shown) for later insertion into a munition. The munition 6 when filled with the precure 5 is exposed to heat, which removes the thermally labile blocking group on the blocked cross linking reagent 4, furnishing the cross linking reagent. The cross linking reagent and HTPB polymerisable binder may then polymerise and form a polymer bonded explosive 7.

Turning to FIGS. 2*a* and 2*b* there is a general scheme 11, for filling a munition 16, optionally via filling funnel 19(FIG. 2*b*). The premix formulation, is a mixture of the explosive, HTBP polymerisable binder other processing aids, optionally a catalyst and a cross linking reagent with at least two labile blocking groups 14, are added to the premix to form the precure composition 15. The cross linking reagent may be a diisocyanate such as IPDI. The resultant precure admixture 15 in the munition is located on a platform 13, which is in mechanical contact with a resonant acoustic mixing stimulus source 17 to provide resonance at a frequency of 58 to 60 Hz. In order to secure the munitions 16 in place, they may be placed in a rack system 12, which may comprise further restraints 12*a*, 12*b* to secure the munition to the rack 12 and platform 13 to ensure that the acoustic, that is vibrational energy, is transferred from the source 17 to the munitions 16 and precure composition 15.

The action of resonant acoustic mixing energy on the precure composition 15, ensures that the composition is thoroughly mixed to a homogenous state, the continued action of resonant acoustic mixing energy causes the labile blocking groups to be removed and release the cross linking reagent into the composition 15. The further action of the resonant acoustic mixing energy causes the released cross linking reagent to mix homogenously and concomitantly react with the HTPB polymerisable binder.

During the resonant acoustic mixing process, the application of a vacuum 18, may assist to degas the curing composition, by removing trapped gases and volatiles, to reduce the instances of voids. The mixing arrangement may require additional thermal control, such as external heating or cooling to control the temperature of the reaction.

Alternatively the composition ingredients may be dosed to a large batch mixing vessel, either volumetrically or by mass. The mixing vessel is then brought into mechanical contact with a resonant acoustic mixing stimulus source 17 to provide a batch cure process. The resulting curing composition may then be transferred to munitions or pots, in the standard manner.

Turning to FIG. 3 there is provided a continuous resonant acoustic mixer system 21, comprising a mixer 28, which is primed with the components via continuous inlet feeds 24. A resonant acoustic mixing stimulus 27 provides mixing and assists with starting the cure process.

The action of resonant acoustic mixing energy on the precure composition ensures that the composition is thoroughly mixed to a homogenous state, the continued action of resonant acoustic mixing energy causes the labile blocking groups to be removed and release the cross linking reagent into the composition. The further action of the resonant acoustic mixing energy causes the released cross linking reagent to mix homogenously and concomitantly react with the HTPB polymerisable binder.

The curing admixture is then transferred via a pipe 29 to fill the munition 26. The filling may be carried out volumetrically, by mass and optionally under a vacuum. The munition 26 may additionally be subject to resonant acoustic mixing to ensure homogeneity.

It should be appreciated that the compositions of the invention are capable of being incorporated in the form of a variety of embodiments, only a few of which have been illustrated and described above.

The invention claimed is:

1. A process for filling a munition with a homogenous crosslinked polymer bonded explosive composition, the process comprising:

forming an admixture of pre-cure castable explosive composition, comprising an explosive material, a polymerisable binder, and a cross linking reagent which comprises at least two reactive groups each of which is protected by a labile blocking group, wherein the labile blocking group comprises at least one resonant acoustic mixing stimulus labile linkage;

filling the munition with the admixture; and applying a resonant acoustic mixing stimulus to the munition causing the at least one resonant acoustic mixing stimulus labile linkage to be removed and release said cross linking reagent, to cause a cure process to start in the munition.

2. The process according to claim 1, wherein the polymerisable binder is selected, such that it will form with the cross linking reagent a compound selected from a polyurethane, a cellulosic material, a polyester, a polybutadiene, a polyethylene, a polyisobutylene, polyvinyl acetate (PVA), chlorinated rubber, an epoxy resin, a two-pack polyurethane system, alkyd/melanine, a vinyl resin, an alkyd, a butadiene-styrene block copolymer, polyNIMMO (poly(3-nitratomethyl-3-methyloxetane)), polyGLYN (poly glycidyl nitrate), a glycidyl azide polymer (GAP), and blends, copolymers and/or combinations thereof.

3. The process according to claim 1, wherein the explosive material is selected from RDX (cyclo-1,2,3-trimethylene-2,4,6-trinitramine, Hexogen), HMX (cyclo-1,3,5,7-tetramethylene-2,4,6,8-tetranitramine, Octogen), FOX-7 (1,1-diamino-2, 2-dinitroethene), TATND (tetranitrotetraminodecalin), FINS (hexanitrostilbene), TATB (triaminotrinitrobenzene), NTO (3-nitro-1,2,4-triazol-5-one), HNIW (2,4,6,8,10,12-hexanitrohexaazaisowurtzitane), GUDN (guanyldylurea dinitride), picrite (nitroguanidine), an aromatic nitramine, ethylene dinitramine, nitroglycerine, butane triol trinitrate, pentaerythritol tetranitrate, DNAN (dinitroanisole), TNT (trinitrotoluene), an inorganic oxidiser, and (ammonium dinitramide), ammonium perchlorate, an energetic alkali metal salt, an energetic alkaline earth metal salt, and combinations thereof.

4. The process according to claim 1, wherein the labile blocking group comprises at least two nitro groups or at least one sterically hindered branched chain hydrocarbyl group.

5. The process according to claim 1, wherein the polymerisable binder and cross linking reagent are partially reacted together to provide a partially polymerised binder-cross linking reagent, wherein at least one of the at least two reactive groups of the cross linking reagent is protected by the labile blocking group.

6. The process according to claim 1, wherein the polymerisable binder is selected such that it will from polyurethane.

7. The process according to claim 1, wherein the cross linking reagent comprises a diisocyanate.

8. The process according to claim 7, wherein the diisocyanate labile blocking group B is selected from:

$NHR^2R^3$, wherein $R^2$ and $R^3$ are alkyl, alkenyl, branched-chain alkyl, $C(O)R^{12}$, aryl, phenyl, or together form a heterocycle, wherein $R^{12}$ is alkyl, alkenyl, branched chain alkyl aryl, phenyl, or $R^2$ and $R^3$ together form a lactam; or $OR^{15}$, $O{-}N{=}CR^9R^{10}$, wherein $R^{15}$ is aryl, phenyl, benzyl, provided that there are at least two nitro group on the ring, and wherein $R^9$ and $R^{10}$ are independently selected from alkyl, alkenyl, branched chain alkyl, aryl, phenyl, provided that at least one of $R^9$ or $R^{10}$ is a branched chain alkyl or aryl, or phenyl.

9. The process according to claim 1, wherein a defoaming reagent is present in a range from 0.01-2 wt %.

10. The process according to claim 1, wherein the process is a batch process.

11. The process according to claim 2, wherein the explosive material is selected from RDX (cyclo-1,2,3-trimethylene-2,4,6-trinitramine, Hexogen), HMX (cyclo-1,3,5,7-tetramethylene-2,4,6,8-tetranitramine, Octogen), FOX-7 (1,1-diamino-2, 2-dinitroethene), TATND (tetranitrotetraminodecalin), FINS (hexanitrostilbene), TATB (triaminotrinitrobenzene), NTO (3-nitro-1,2,4-triazol-5-one), HNIW (2,4,6,8,10,12-hexanitrohexaazaisowurtzitane), GUDN (guanyldylurea dinitride), picrite (nitroguanidine), an aromatic nitramine, ethylene dinitramine, nitroglycerine, butane triol trinitrate, pentaerythritol tetranitrate, DNAN (dinitroanisole), TNT (trinitrotoluene), an inorganic oxidiser, and (ammonium dinitramide), ammonium perchlorate, an energetic alkali metal salt, an energetic alkaline earth metal salt, and combinations thereof.

12. The process according to claim 11, wherein the labile blocking group comprises at least two nitro groups or at least one sterically hindered branched chain hydrocarbyl group.

13. The process according to claim 11, wherein the polymerisable binder and cross linking reagent are partially reacted together to provide a partially polymerised binder-cross linking reagent, wherein at least one of the at least two reactive groups of the cross linking reagent is protected by the labile blocking group.

14. The process according to claim 11, wherein the polymerisable binder is selected such that it will from polyurethane.

15. The process according to claim 14, wherein the cross linking reagent comprises a diisocyanate.

16. The process according to claim 1, wherein a defoaming reagent is present in a range from 0.01-2 wt %.

17. A process for formulating a homogenous crosslinked polymer bonded explosive composition, the process comprising:

forming an admixture of a pre-cure castable explosive composition, said composition comprising an explosive material, a polymerisable binder, and a cross linking reagent which comprises at least two reactive groups each of which is protected by a labile blocking group, wherein the labile blocking group comprises at least one resonant acoustic mixing stimulus labile linkage; and initiating a cure process by applying a resonant acoustic mixing stimulus to the admixture, thereby causing the at least one resonant acoustic mixing stimulus labile linkage to be removed and to release said cross linking reagent, wherein the resonant acoustic mixing stimulus has a frequency of less than 200 Hz.

18. The process according to claim 1, wherein the resonant acoustic mixing stimulus has a frequency of less than 200 Hz.

19. The process according to claim 18, wherein the resonant acoustic mixing stimulus has a frequency from 58 Hz to 60 Hz.

20. The process according to claim 11, wherein the diisocyanate labile blocking group B is a blocked isocyanate selected from:

$NHR^2R^3$, wherein $R^2$ and $R^3$ are alkyl, alkenyl, branched-chain alkyl, $C(O)R^{12}$, aryl, phenyl, or together form a heterocycle, wherein $R^{12}$ is alkyl, alkenyl, branched chain alkyl aryl, phenyl, or $R^2$ and $R^3$ together form a lactam; or $OR^{15}$, $O{-}N{=}CR^9R^{10}$, wherein $R^{15}$ is aryl, phenyl, benzyl, provided that there are at least two nitro group on the ring, and wherein $R^9$ and $R^{10}$ are independently selected from alkyl, alkenyl, branched chain alkyl, aryl, phenyl, provided that at least one of $R^9$ or $R^{10}$ is a branched chain alkyl or aryl, or phenyl.

* * * * *